US007927556B2

(12) United States Patent
Salmon

(10) Patent No.: US 7,927,556 B2
(45) Date of Patent: Apr. 19, 2011

(54) CATALYTIC NAPHTHA REFORMING PROCESS

(75) Inventor: Emigdio Jesus Salmon, Dhahran (SA)

(73) Assignee: Saudi Arabian Oil Company (SA)

( * ) Notice: Subject to any disclaimer, the term of this patent is extended or adjusted under 35 U.S.C. 154(b) by 552 days.

(21) Appl. No.: 12/031,358

(22) Filed: Feb. 14, 2008

(65) Prior Publication Data

US 2008/0131338 A1 Jun. 5, 2008

Related U.S. Application Data

(62) Division of application No. 10/623,167, filed on Jul. 18, 2003, now Pat. No. 7,351,325.

(51) Int. Cl.

| | |
|---|---|
| ***B01J 8/00*** | (2006.01) |
| *B01J 10/00* | (2006.01) |
| *B01J 8/04* | (2006.01) |
| *B01J 19/00* | (2006.01) |
| *B01J 19/30* | (2006.01) |

(52) U.S. Cl. ..... 422/187; 422/129; 422/600; 422/630; 422/631; 422/198

(58) Field of Classification Search ..... 422/187–190, 422/129, 600, 630, 631, 198; 208/52 R, 208/62–66, 133–141, 49

See application file for complete search history.

(56) References Cited

U.S. PATENT DOCUMENTS

| | | | | |
|---|---|---|---|---|
| 2,401,649 | A | | 6/1946 | Leffer |
| 2,905,620 | A | | 9/1959 | Haensel |
| 2,940,921 | A | | 6/1960 | Malloy |
| 2,967,822 | A | | 1/1961 | Moy |
| 3,001,928 | A | | 9/1961 | Grote |
| 3,431,195 | A | * | 3/1969 | Storch et al. ..... 208/101 |
| 3,520,800 | A | * | 7/1970 | Forbes ..... 208/101 |
| 3,974,064 | A | * | 8/1976 | Bajek et al. ..... 208/134 |
| 4,049,539 | A | | 9/1977 | Yan et al. |
| 4,069,135 | A | * | 1/1978 | Giuliani ..... 208/65 |
| 4,110,197 | A | * | 8/1978 | Herning et al. ..... 208/64 |
| 4,233,268 | A | | 11/1980 | Boret et al. |
| 4,325,807 | A | * | 4/1982 | Peters ..... 208/64 |
| 4,401,554 | A | | 8/1983 | Choi et al. |
| 4,483,766 | A | * | 11/1984 | James, Jr. ..... 208/134 |
| 4,560,536 | A | * | 12/1985 | Tabak ..... 422/116 |
| 4,839,024 | A | | 6/1989 | Ramage et al. |
| 4,950,385 | A | | 8/1990 | Sivasanker et al. |

(Continued)

FOREIGN PATENT DOCUMENTS

CA 1094494 A * 1/1981

(Continued)

*Primary Examiner* — Walter D Griffin
*Assistant Examiner* — Natasha Young
(74) *Attorney, Agent, or Firm* — Bracewell & Giuliani LLP

(57) ABSTRACT

A process and apparatus for catalytic reforming of hydrocarbons wherein the effluent stream from the first and/or second reactor of a reforming train with several reactors in series is cooled in a multistage process to remove aromatic compounds in the reacting medium prior to being reheated and returned to subsequent reactors for additional reaction to occur. The partial removal of aromatic compounds enhances the driving force for the conversion of paraffins and naphthenes by making the equilibrium more favorable to such conversion. The removal of aromatic compounds reduces the size of downstream process equipment thereby reducing capital costs and lowering energy usage. It is possible to add additional feed streams to reactors downstream of the intermediate reactor effluent cooling step thereby making the process unit capable of processing more feedstock to produce more product.

17 Claims, 5 Drawing Sheets

U.S. PATENT DOCUMENTS

| | | | | |
|---|---|---|---|---|
| 5,203,988 | A | | 4/1993 | Swan, III et al. |
| 5,552,033 | A | | 9/1996 | Shih |
| 5,658,453 | A | | 8/1997 | Russ et al. |
| 5,672,265 | A | | 9/1997 | Schmidt et al. |
| 5,770,045 | A | | 6/1998 | Gosling et al. |
| 5,858,209 | A | | 1/1999 | Schmidt et al. |
| 5,879,537 | A | * | 3/1999 | Peters ..... 208/134 |
| 5,890,378 | A | | 4/1999 | Rambo et al. |
| 7,351,325 | B2 | | 4/2008 | Salmon |

FOREIGN PATENT DOCUMENTS

| | | | | |
|---|---|---|---|---|
| CA | 1094494 | A1 | | 1/1981 |
| DE | 1088643 | B | | 9/1960 |
| EP | 0343920 | A1 | | 11/1989 |
| JP | 52119604 | A | | 10/1977 |
| JP | 03093893 | A | * | 4/1991 |
| JP | 3093893 | A | | 4/1991 |
| JP | 05219604 | A | * | 8/1993 |

* cited by examiner

CATALYTIC NAPHTHA REFORMING PROCESS

CROSS REFERENCE TO RELATED APPLICATIONS

This application claims priority to, and is a divisional application of, U.S. application Ser. No. 10/623,167 filed on Jul. 18, 2003, now issued at U.S. Pat. No. 7,351,325, which is hereby incorporated by reference in its entirety.

BACKGROUND OF THE INVENTION

1. Technical Field of the Invention

The present invention relates to catalytic naphtha reformers and catalytic reforming processes. More particularly, this invention relates to a method and apparatus to take advantage of thermodynamic and chemical equilibrium parameters to increase efficiency of the processes in producing larger quantities of octane enhancing components and reducing the amount of gas formed thereby lowering operating cost.

2. Description of the Prior Art

Catalytic reforming is generally used to reform low octane naphthas into high octane gasoline blending components referred to as reformates. Numerous reactions such as cracking, polymerization, dehydrogenation, and isomerization occur simultaneously during reforming. Depending upon the properties of the naphtha feedstock and catalysts used, reformates can be produced with high concentrations of such constituents as benzene, toluene, xylene, and other aromatic compounds that are useful in gasoline blending and petrochemical processing.

Generally, the feedstock to a reformer is a naphtha stream, which includes three types of organic chemical compounds with carbon numbers in the range of five to ten. These compounds are classified primarily as paraffins, naphthenes, and aromatics. Each of these chemical compounds reacts differently in the presence of the typical dual functionality reforming catalyst. One of the functions is the rearrangement or isomerization reaction performed by the acidic site while the second is the hydrogenation/dehydrogenation reaction performed by the metallic site.

The goal of most naphtha catalytic reforming processes is to form aromatic compounds with high octane rating. The napthenes in the naphtha feed streams react very quickly to form aromatic compounds. Paraffins, on the other hand, are very unreactive and require higher temperatures to be converted to aromatic compounds. The aromatic compounds essentially undergo very little reaction in the normal situation. However, these aromatic compounds can undergo cracking reactions in environments with temperatures in the range of about 960° F. to 980° F. In particular, the rate of formation for toluene and higher carbon atoms compounds appear to level off at around 970° F. to about 980° F., while that of benzene continues to increase in the same temperature range.

Naphthenes react very quickly and convert to aromatics to the extent allowed by equilibrium considerations by the time the reacting medium exits the first of three or four reforming reactors in series in a typical reforming process. This, in essence, means that all naphthenes are basically depleted in the first reactor. After the naphthenes convert to aromatics then it becomes imperative to convert the paraffins, which is much harder to do since there are more steps required to convert a typical paraffin to an aromatic compound. For example, hexane has to be converted to cyclohexane then it has to undergo a dehydrogenation step to become benzene. Energy and favorable equilibrium conditions are required for these extra steps to occur. The energy required is generally supplied by external means in the form of heat.

Since these reforming reactions are generally endothermic in nature, the feed to each of the several reactors in series in the reforming train is heated to reaction temperature in external heaters to the reactors.

The competition between the reactions to form aromatics and cracking or dealkylation reactions undergone by the aromatics at higher temperatures cause most catalytic processes to be inefficient. In such environments, aromatic compounds are being formed and depleted concurrently. These competing reactions tend to discourage using higher temperatures in reactors in the first place because the higher operating temperatures tend to cause some of the aromatic compounds to undergo cracking or de-alkylation reactions, which result in the formation of undesirable hydrocarbons with carbon numbers less than five. At the same time, higher temperatures are required to cause the reactions of paraffins to aromatics. It is desirable in reforming reactions to maximize formation of aromatic compounds with carbon numbers in the range of about six to about ten while, at the same time, minimize the formation of gaseous hydrocarbons with carbon numbers less than five.

Others have attempted to increase the amount of aromatic compounds that are produced in reforming processes. One such example can be found in U.S. Pat. No. 4,401,554 issued to Choi et al. (hereinafter "Choi"). In Choi, a naphtha feed stream is separated into two fractions prior to being sent to a reformer reactor train. The first fraction, which contains the heavy fraction, is sent through at least three catalyst zones and the second fraction, which contains the light fraction, is only sent through to the last catalyst zones. The heavy fraction passes through the entire sequence of catalytic reactors undergoing severe reforming conditions in terms of temperature and time while the light fraction is processed only in the last one or two reactors. These severe conditions lead to dealkylation reactions of $C_7$ and heavier aromatic compounds particularly at high temperatures. This tends to reduce the total amount or volume of reformate composed of $C_5$ and heavier and impacts the economics of the process.

In U.S. Pat. No. 5,672,265 issued to Schmidt et al, this patent discloses a reforming process for full range naphtha. The effluent of the last reactor in the reformer train is separated into fractions. The light fraction is composed of hydrogen and hydrocarbons lighter than $C_5$ and the heavier fraction is composed of the reformate for use in gasoline blending. The reformate stream is further treated through an extractive distillation column or beds of molecular sieves to extract paraffinic compounds in the molecular weight range of $C_6$-$C_8$. These paraffinic compounds are fed to a reformer-type reactor containing an aromatization catalyst, as opposed to a reforming catalyst. The inclusion of the extractive distillation process is cost prohibitive, particularly when coupled with the reforming-type step.

Another process for increasing the amount of aromatic compounds produced in a reforming process is described in U.S. Pat. No. 4,950,385 issued to Sivasanker et al. (hereinafter "Sivasanlcer"). In Sivasanker, two different catalysts are used in two catalyst zones within the reactor train. The reformate stream from the second catalyst zone is split into two fractions with the high pressure fraction, hydrogen and hydrocarbons with carbon numbers less than three primarily being recycled back to the first catalyst zone containing a conventional reforming catalyst and the low pressure fraction being recycled back to the catalyst zone containing an acidic reforming catalyst having a crystalline iron silicate. However, to use separate reactor trains to hold each of the two such catalyst can be relatively expensive to operate when compared with the use of single conventional reforming catalysts.

A need exists for a more economical and efficient method of increasing the amount of aromatics that are produced from a hydrocarbon stream during catalytic reforming. It would be advantageous to provide a method that makes it easier to convert the paraffins to aromatics while simultaneously reducing the cracking or dealkylation tendency of the aromatic compounds. A process apparatus to increase the amount of aromatic compounds produced from a hydrocarbon stream that uses smaller reactors than conventional reforming processes would be advantageous from the investment and operating cost perspective. Additionally, it would be advantageous to add the modified catalytic reforming process to an existing catalytic reforming process.

SUMMARY OF THE INVENTION

In order to meet one or more of these goals, the present invention advantageously provides a process and apparatus for increasing the concentration of aromatic compounds during catalyst reforming reactions by taking advantage of thermodynamic and chemical equilibrium considerations while utilizing readily available reactors to create a process and new apparatus that is more efficient than current technologies and less costly than other current alternate technologies.

More specifically, a process for forming aromatic compounds from a hydrocarbon stream is provided. The process includes supplying and reacting a hydrocarbon feed stream in a first reactor to produce a first reactor effluent stream. The first effluent stream is then cooled and at least partially condensed in a first cooler to produce a first vapor stream and a first liquid stream. The first vapor stream is cooled and at least partially condensed in a second cooler to produce a second vapor stream and a second liquid stream. The first and second liquid streams are combined and cooled before being sent to a reformate pool for further processing. The first reactor can be a stand-alone reactor or can be part of a series of reformer reactors. The second vapor stream is then heated prior to sending the second vapor stream to a second reactor. Once the second vapor stream is sent to the second reactor, the remaining process steps of the reforming process can take place as in a typical reformer process as understood by those skilled in the art.

Another process for forming aromatic compounds from a hydrocarbon stream is also advantageously provided. In this embodiment, a hydrocarbon feed stream is supplied to a first reactor where it reacts to produce a first reactor effluent stream. The first reactor effluent stream is cooled and at least partially condensed in a first cooler to produce a first vapor stream and a first liquid stream. The first vapor stream is then cooled and at least partially condensed in a second cooler to produce a second vapor stream and a second liquid stream. The first and second liquid streams are then combined and cooled prior to being sent to a reformate pool for further processing. The second vapor stream is heated and then split into a first portion and a second portion. The first portion of the second vapor stream is sent to the second reactor and the second portion of the second vapor stream is sent to a third reactor. The first portion of the second vapor stream in the second reactor reacts to produce a second reactor effluent stream. The second reactor effluent stream is then combined with the first reactor effluent stream prior to cooling and at least partially condensing the first reactor effluent stream in the first cooler. Since the streams are combined, the second reactor effluent stream is also cooled and at least partially condensed along with the first reactor effluent stream. As with all process embodiments of the present invention, the remaining steps of the reforming process occur as understood by those skilled in the art.

In addition to the method embodiments of the present invention, an apparatus for forming aromatic compounds from a hydrocarbon stream is also advantageously provided. The apparatus of the present invention preferably includes a first reactor, a first cooler, a second cooler, a third cooler to further cool the total aromatic stream for blending into the gasoline pool, a first heater, and a second reactor. The apparatus included in the present invention includes the equipment necessary to perform the improvement made to a typical reforming process. Additional equipment is necessary to perform an entire reforming process and will be known to those skilled in the art.

The first reactor receives and allows for reaction of a hydrocarbon feed stream to produce a first reactor effluent stream. The first cooler acts to cool and partially condense the first reactor effluent stream to produce a first vapor stream and a first liquid stream. The second cooler receives the first vapor stream for cooling and at least partially condensing the first vapor stream to produce a second vapor stream and a second liquid stream. The third cooler cools the first and second liquid streams. The first heater heats the second vapor stream to produce a heated second vapor stream. The second reactor receives the heated second vapor stream.

In all embodiments of the present invention, aromatic compounds are removed from reactor effluent streams, which lowers the concentration of aromatic in the stream fed to the next reactor thereby enhancing the driving force for formation of aromatics. The concentration of aromatic compounds in the reacting medium is altered to force the chemical equilibrium to become more favorable for the formation of aromatic compounds, rather than naphthenes. Since aromatic compounds are the most desired products from catalytic reforming processes, it is desirable to produce increased amount of aromatics. With the removal of the aromatic compounds from the reactor series, this also enables operators to increase an amount of feed that can be sent to subsequent reactors in an equivalent amount to that of aromatics removed between reactors. This increases the overall yield of the process.

In a preferred embodiment, the first reactor operates at a pressure in the range of approximately 15 psig to 1000 psig and at a temperature in the range of approximately 400° F. to 1000° F.

BRIEF DESCRIPTION OF THE DRAWINGS

So that the manner in which the features, advantages and objects of the invention, as well as others that will become apparent, may be understood in more detail, more particular description of the invention briefly summarized above may be had by reference to the embodiment thereof which is illustrated in the appended drawings, which form a part of this specification. It is to be noted, however, that the drawings illustrate only a preferred embodiment of the invention and is therefore not to be considered limiting of the invention's scope as it may admit to other equally effective embodiments.

DETAILED DESCRIPTION OF THE DRAWINGS

Figure 1:
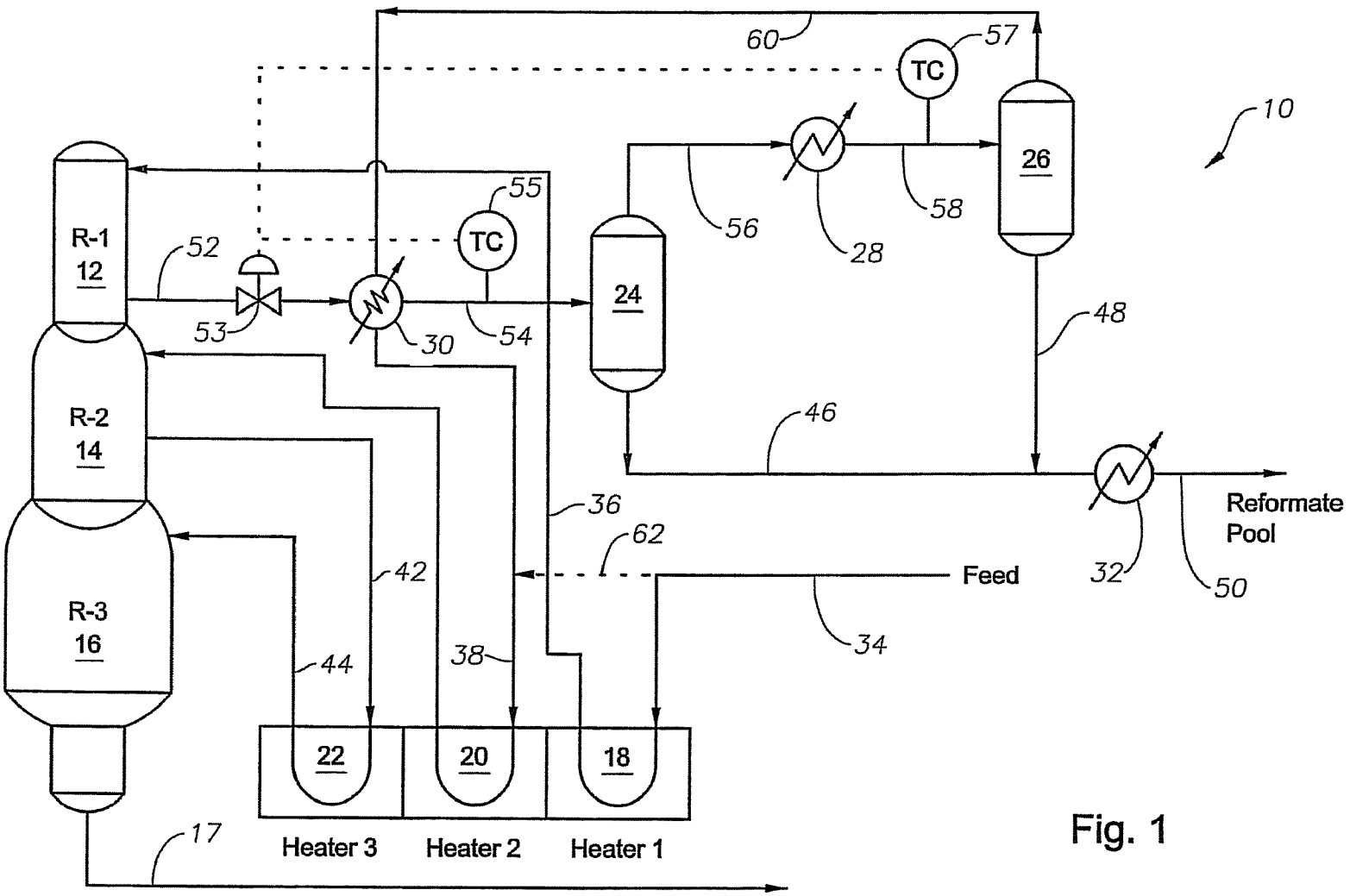
FIG. 1 is a simplified flow diagram of an embodiment of a catalytic reforming process that incorporates the improvements of the present invention and is configured for increased recovery of aromatics by removing a portion of a first reactor effluent stream in accordance with one embodiment of the present invention.
Figure 2:
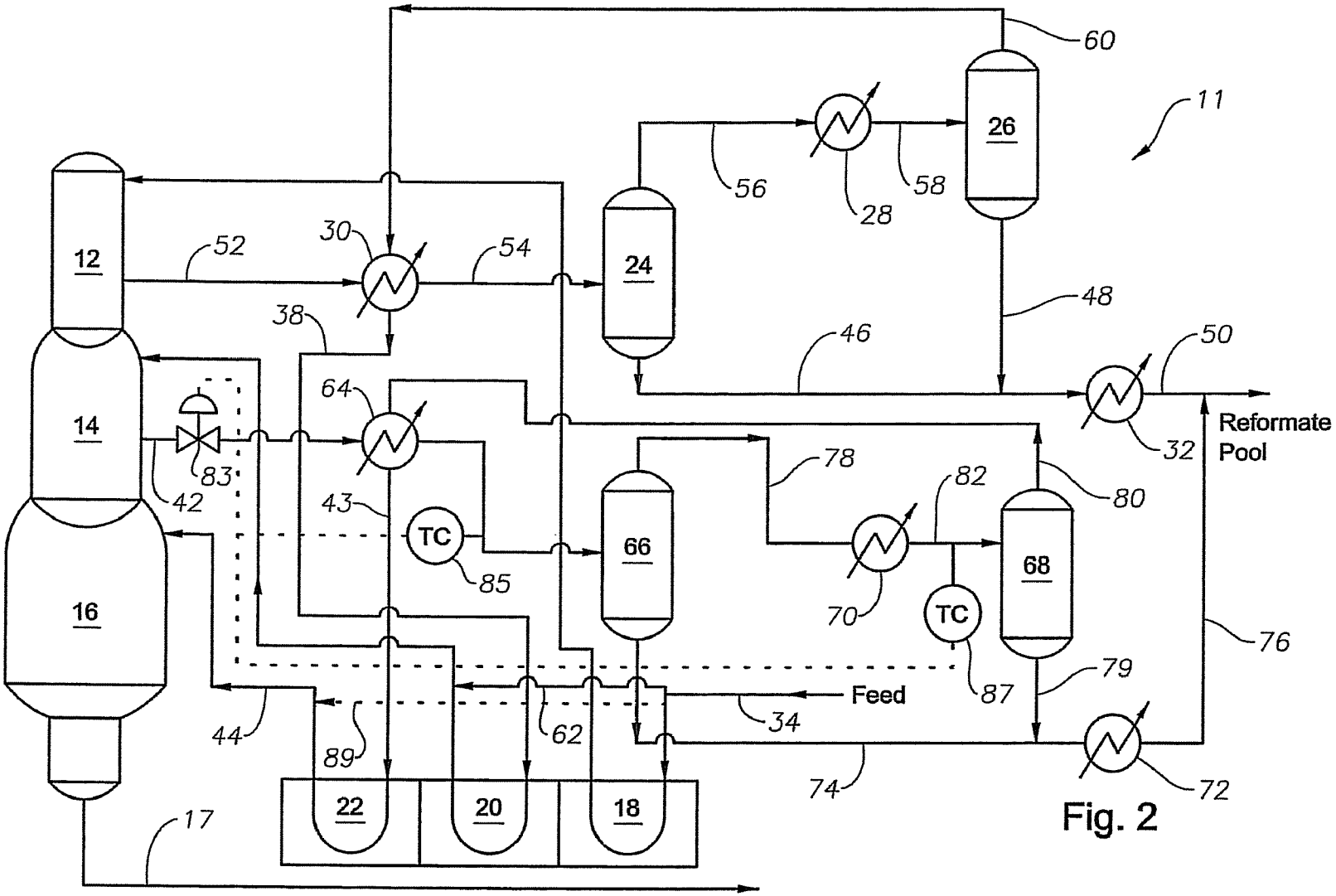
FIG. 2 is a simplified flow diagram of an embodiment of a catalytic reforming process that incorporates the improvements of the present invention and is configured for increased recovery of aromatics by removing a portion of a first and a second reactor effluent streams in accordance with an embodiment of the present invention.
Figure 3:
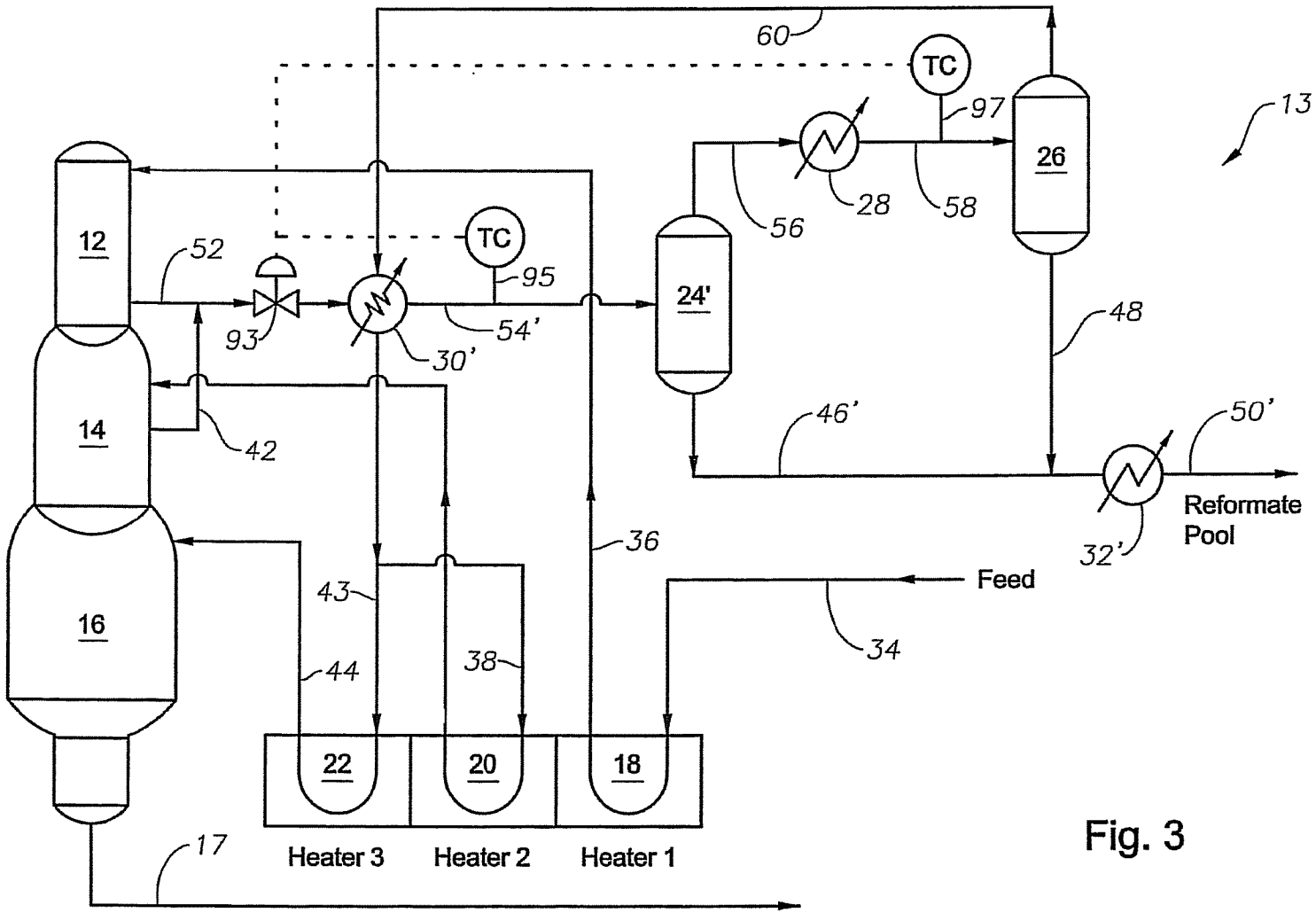
FIG. 3 is a simplified flow diagram of an embodiment of a catalytic reforming process that incorporates the improvements of the present invention and is configured for increased recovery of aromatics by removing a portion of a first and a second reactor effluent streams, wherein the first and second reactor effluent streams are combined prior to being removed from the process, in accordance with an embodiment of the present invention.
Figure 4:
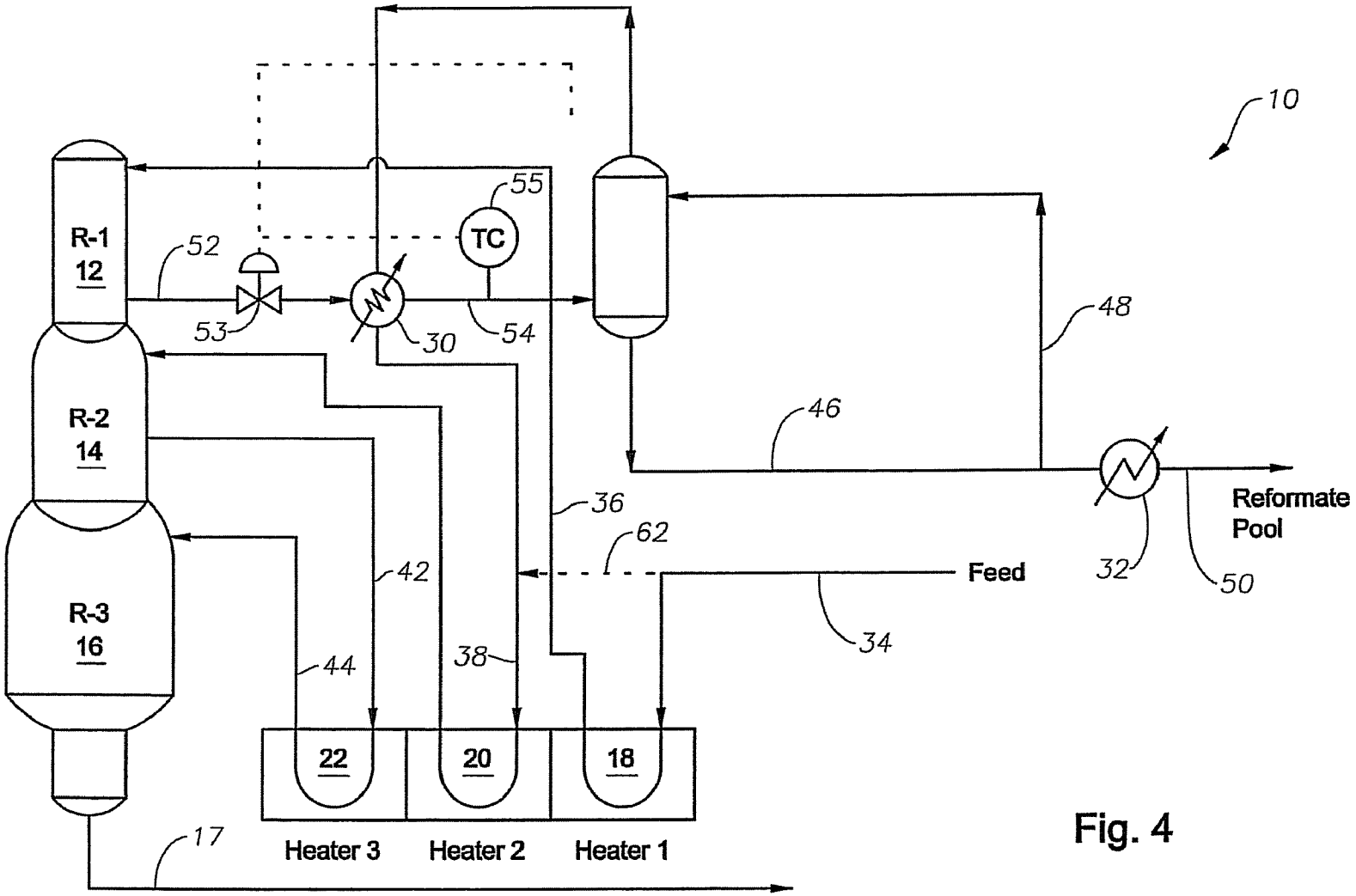
FIG. 4 is a simplified flow diagram of an alternative embodiment of a catalytic reforming process that incorporates the improvements of the present invention and is configured for increased recovery of aromatics by removing a portion of a first reactor effluent stream in accordance with one embodiment of the present invention.
Figure 5:
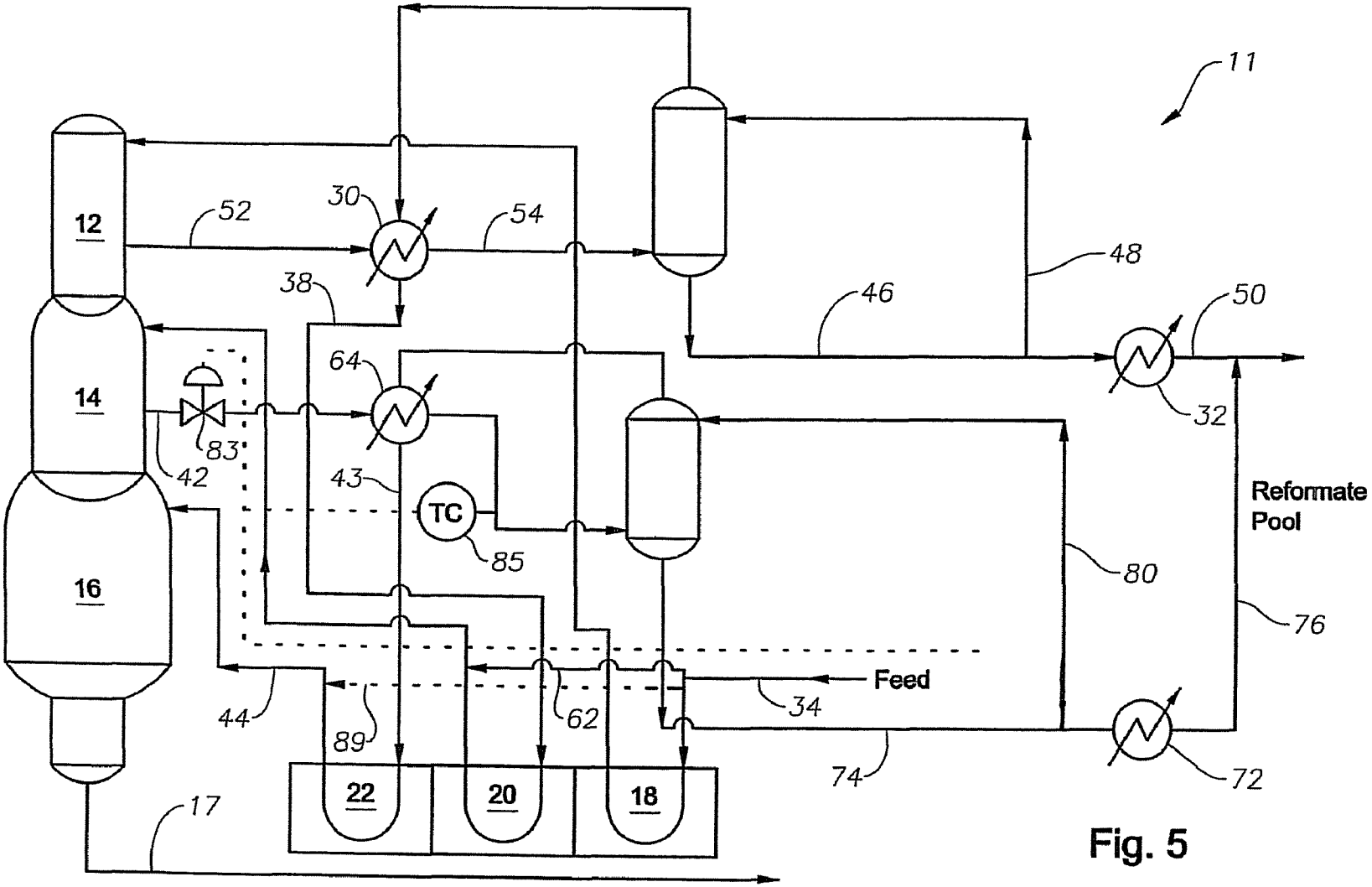
FIG. 5 is a simplified flow diagram of an alternative embodiment of a catalytic reforming process that incorporates the improvements of the present invention and is configured for increased recovery of aromatics by removing a portion of a first and a second reactor effluent streams in accordance with an embodiment of the present invention.

For simplification of the drawings, item numbers may be the same in FIGS. 1 through 3 for various streams and equipment when the functions are the same, with respect to the streams or equipment, in each of the figures.

The present invention advantageously includes a process for forming aromatic compounds from a hydrocarbon feed stream 34, as illustrated in FIG. 1. The process preferably includes supplying and reacting hydrocarbon feed stream 34 in a first reactor 12 to produce a first reactor effluent stream 52. Hydrocarbon feed stream 34 preferably includes a significant amount of hydrocarbons containing a range of five to ten carbon atoms and is preferably supplied at a temperature in the range of about 500° F. to about 1200° F. and a pressure in the range of about 15 psig to about 100 psig. Another preferred embodiment includes supplying the hydrocarbon feed stream at a temperature in the range of about 800° F. to about 1200° F. and a pressure in the range of about 15 psig to about 250 psig. More preferably, the boiling range of the hydrocarbon feed stream includes a range falling substantially between 80° F. to 400° F. It is understood by those in the art that initial boiling points and end points can vary on otherwise similar hydrocarbon feed streams. First reactor effluent stream 52 is then cooled, preferably to a temperature in the range of about 250° F. to about 400° F., and at least partially condensed in a first cooler 30 to produce a cooled effluent stream 54 which is then separated in a first separator 24 to produce a first vapor stream 56 and a first liquid stream 46. Cooling first reactor effluent stream 52 allows part of the high boiling aromatic compounds in first reactor effluent stream 52 to condense resulting in first liquid stream 46 containing high boiling aromatic compounds. First vapor stream 56 is then preferably cooled and at least partially condensed in a second cooler 28 to produce a cooled first vapor stream 58 which is then separated in a second separator 26 to produce a second vapor stream 60 and a second liquid stream 48. Second liquid stream 48 includes the lower boiling aromatic compounds. First vapor stream 56 is preferably cooled to a temperature in a range of about 220° F. to about 360° F. More preferably, first vapor stream 56 is cooled to a temperature in the range of 240° F. to about 360° F. First and second liquid streams 46, 48, which contains high and low boiling liquid streams, are combined and cooled in third cooler 32 before being sent to a reformate pool for further processing as desired. Second vapor stream 60 is then heated, preferably to a temperature in the range of about 800° F. to about 1200° F., prior to sending second vapor stream 60 to a second reactor 14.

The step of cooling first reactor effluent stream 52 can include cooling first reactor effluent stream 52 by heat exchange contact with second vapor stream 60 thereby simultaneously performing the step of heating second vapor stream 60. In other words, first reactor effluent stream 52 can be cooled and second vapor stream 60 can be heated simultaneously in the same exchanger 30 with heat exchange contact between the two streams 52, 60 to capture part of the heat released during the first cooling step. Second vapor stream 60 can then be forwarded to another heater 20 for additional heat prior to being sent to second reactor 14.

Cooling first reactor effluent stream 52 and removing aromatic compounds results in a net reduction in the concentration of aromatic compounds in second vapor stream 60, which acts as an intermediate hydrocarbon feed stream to second reactor 14. The lower concentration of aromatics in the second vapor stream sent to second reactor 14 tends to cause the reaction equilibrium to shift so that the formation of more aromatic compounds in second reactor 14 is favored. Paraffins concentration within the second vapor stream 60 can be higher in some cases, which is also advantageous for second reactor 14 from a reaction kinetics point of view within second reactor 14.

Hydrocarbon feed stream 34 can also be sent to second reactor 14 directly as a second hydrocarbon feed stream 62 as shown in FIG. 2. This enables second reactor 14 to produce more aromatics since the amount of feed coming from first reactor 12 has been reduced with the removal of the aromatic compounds 50.

In all embodiments of the present invention, the step of cooling first reactor effluent stream 52 can be controlled based upon a first discharge temperature 55 of first cooler 30 and a second discharge temperature 57 of second cooler 28. A temperature controller 53 can be used on first reactor effluent stream 52, which is controlled by first discharge temperature 55 and second discharge temperature 57. Temperature controller 53 can be any type of control device, such as a temperature control valve, that will enable the flow of first reactor effluent stream 52 to be controlled. Suitable controllers will be known to those skilled in the art and are to be considered within the scope of the present invention.

As another embodiment of the present invention, the process can also include reacting second vapor stream 60 in second reactor 14 to produce a second reactor effluent stream 42, as illustrated in FIG. 2. Second reactor effluent stream 42 is cooled, preferably in a range of about 250° F. to about 400° F., and at least partially condensed in a fourth cooler 64 and cooled in a third separator 66 to produce a third vapor stream 78 and a third liquid stream 74. Third vapor stream 78 is then cooled and at least partially condensed in a fifth cooler 70 to produce a cooled third vapor stream 82 which is then separated in a fourth separator 68 to produce a fourth vapor stream 80 and a fourth liquid stream 79. Third and fourth liquid streams 74, 79 are preferably combined and cooled in sixth cooler 72 prior to sending them to the reformate pool for further processing. Fourth vapor stream 80 is heated prior to being sent to third reactor 16. Reformate 17 is produced from the third reactor or a final reactor. In a preferred embodiment, the reformate exchanges heat with incoming feed stream 34.

Similar to second reactor 14, a portion of hydrocarbon feed stream 34 can be sent directly to third reactor 16 as a third hydrocarbon feed stream 89. This enables third reactor 16 to produce more aromatics since the amount of feed coming from second reactor 14 has been reduced with the removal of the aromatic compounds 76.

In all embodiments of the present invention, the step of cooling second reactor effluent stream 42 can be controlled based upon a first discharge temperature 85 of fourth cooler 64 and a second discharge temperature 87 of fifth cooler 70. A second temperature controller 83 can be used on second reactor effluent stream 42, which is controlled by first discharge temperature 85 and second discharge temperature 87. Temperature controller 83 can be any type of control device, such as a temperature control valve, that will enable the flow of second reactor effluent stream 42 to be controlled. Suitable controllers will be known to those skilled in the art and are to be considered within the scope of the present invention.

As another embodiment of the present invention, a process for forming aromatic compounds from a hydrocarbon stream is advantageously provided as illustrated in FIG. 3. In this embodiment, a hydrocarbon feed stream 34 is supplied and reacted in a first reactor 12 to produce a first reactor effluent stream 52, which is then cooled and at least partially condensed in a first cooler 30 to produce a cooled effluent stream 54' which is then separated in a first separator 24'. A first vapor stream 56 and a first liquid stream 46' are produced as a result of the cooling and condensing of the first reactor effluent stream 52. First vapor stream 56 is cooled and at least partially condensed in a second cooler 28 to produce a second vapor stream 60 and a second liquid stream 48. The first and second liquid streams 46', 48 are then combined and cooled in a third cooler 32' prior to being sent to a reformate pool for further processing. Second vapor stream 60 is heated and then split with a first portion of second vapor stream 38 being sent to second reactor 14 and a second portion of second vapor stream 43 being sent to a third reactor 16. First portion of second vapor stream 38 is reacted in the second reactor to produce a second reactor effluent stream 42. Second reactor effluent stream 42 is preferably combined with first reactor effluent stream 52 prior to cooling and at least partially condensing first reactor effluent stream 52 in first cooler 30'. Second reactor effluent stream 42 is cooled and at least partially condensed along with first reactor effluent stream 52.

Hydrocarbon feed stream 34 can also be added to second reactor 14, third reactor 16, and combinations thereof.

In this embodiment of the present invention, the step of cooling first and second reactor effluent streams 52, 42 can be controlled based upon a first discharge temperature 95 of first cooler 30' and a second discharge temperature 97 of fifth cooler 70. A temperature controller 93 can be used on first and second reactor effluent streams 52, 42, which is controlled by first discharge temperature 95 and second discharge temperature 97. Temperature controller 93 can be any type of control device, such as a temperature control valve, that will enable the flow of first and second reactor effluent streams 52, 42 to be controlled. Suitable controllers will be known to those skilled in the art and are to be considered within the scope of the present invention.

The present invention also advantageously includes an apparatus for forming aromatic compounds from a hydrocarbon stream 34. In one embodiment of the present invention, the apparatus preferably includes a first reactor 12, a first cooler 30, a second cooler 28, a third cooler 32, a first heater 30, and a second reactor 14.

First reactor 12 preferably receives and reacts a hydrocarbon feed stream 34 within first reactor 12 to produce a first reactor effluent stream 52. First cooler 30 for cooling and at least partially condensing first reactor effluent stream 52 to produce a first vapor stream 56 and a first liquid stream 46. Second cooler 28 preferably cools and at least partially condenses first vapor stream 56 to produce a second vapor stream 60 and a second liquid stream 48. Third cooler preferably cools first and second liquid streams 46, 48. First heater 30 heats the second vapor stream to produce a heated second vapor stream 38. Second reactor 14 receives the heated second vapor stream 38. First cooler and first heater can comprise a single heat exchanger 30 that provides heat exchange contact between first reactor effluent stream 52 and second vapor stream 60.

The apparatus can also include a first temperature controller 53 for controlling the cooling of first reactor effluent stream 52 based upon a first discharge temperature 55 of first cooler 30 and a second discharge temperature 57 of second cooler 28.

As shown in FIG. 2, the apparatus can also advantageously include a fourth cooler 64, a fifth cooler 70, a sixth cooler 72, a second heater, and a third reactor 16.

Fourth cooler 64 is preferably used for cooling and at least partially condensing second reactor effluent stream 42 to produce a third vapor stream 78 and a third liquid stream 74. Fifth cooler 70 is preferably used for cooling and at least partially condensing third vapor stream 78 to produce a cooled third vapor stream 82 which is then separated in a fourth separator 68 to produce a fourth vapor stream 80 and a fourth liquid stream 79. Sixth cooler 72 is preferably used for cooling third and fourth liquid streams 74, 79. Second heater is preferably used for heating fourth vapor stream 80. Third reactor 16 for receiving the fourth vapor stream 80.

Fourth cooler 64 and second heater can comprise a single heat exchanger 64 that provides heat exchange contact between second reactor effluent stream 42 and fourth vapor stream 80, as shown in FIG. 2.

This embodiment of the present invention can also include a second temperature controller 83 as part of the apparatus for controlling the cooling of second reactor effluent stream 42 based upon a fourth discharge temperature 85 of fourth cooler 64 and a fifth discharge temperature 87 of fifth cooler 70.

As an advantage of the present invention, the amount of feed material 34 that is fed to second reactor 14 and/or third reactor 16 is less than the amount of feed material 34 that is sent to first reactor 12. Lower feed rates in second and third reactors 12, 14 require smaller vessels, which require less capital investment. It is estimated that the size reduction in second and/or third reactors 12, 14 can be around 30%, which is significant. The lower feed rates to the reactors will also require less heat input, which reduces energy consumption, as well. It is estimated that an energy savings of about 30% can be realized by utilizing the present invention in reforming processes.

As another advantage of the present invention, it is believed that the better conversion of paraffins to aromatics will result in an improvement in the octane rating for the reformates produced in the process.

While the invention has been shown or described in only some of its forms, it should be apparent to those skilled in the art that it is not so limited, but is susceptible to various changes without departing from the scope of the invention.

For example, various means of heat exchange can be used to supply the reboiler with heat. The reboiler can be more than one exchanger or be a single multi-pass exchanger. Equivalent types of reboilers will be known to those skilled in the art. As another example, it is envisioned that the process could be packaged in small modules for the convenience of transportation and installation since the process is simple and does not require much process equipment. This is particularly apparent for the embodiments of the invention that is illustrated in FIGS. 1 and 2 of the drawings. As another example, the level controllers can be level control valves or any other type of flow meter or controller capable of controlling an amount of liquid that is allowed to exit the bottom of a vessel. Suitable controllers will be known to those skilled in the art and are to be considered within the scope of the present invention.

I claim:

1. An apparatus for increasing aromatic content of a reformate stream comprising:

a first reactor for receiving and reacting a hydrocarbon feed stream within to produce a first reactor effluent stream;

a first cooler for cooling and partially condensing the first reactor effluent stream to produce a first vapor stream and a first liquid stream and a second cooler for cooling and partially condensing the first vapor stream to produce a second vapor stream and a second liquid stream;

a first heater for heating the second vapor stream to produce a heated second vapor stream;

a second reactor for receiving the heated second vapor stream; and a third cooler for cooling the first and second liquid streams.

2. The apparatus according to claim 1, further comprising a first separator for separating the first vapor stream and the first liquid stream and a second separator for separating the second vapor stream and the second liquid stream.

3. The apparatus according to claim 1, wherein the first cooler and the first heater comprise a single heat exchanger that provides heat exchange contact between the first reactor effluent stream and the second vapor stream.

4. The apparatus according to claim 1, further comprising a first temperature controller for controlling cooling the first reactor effluent stream based upon a first discharge temperature of the first cooler and a second discharge temperature of the second cooler.

5. The apparatus according to claim 1, further comprising:

a fourth cooler for cooling and partially condensing the second reactor effluent stream to produce a third vapor stream and a third liquid stream and a fifth cooler for cooling and partially condensing the third vapor stream to produce a fourth vapor stream and a fourth liquid stream;

a sixth cooler for cooling the third and fourth liquid streams; and a second heater for heating the fourth vapor stream; and a third reactor for receiving the fourth vapor stream.

6. The apparatus according to claim 5 further comprising a third separator for separating the second reactor effluent stream to produce the third vapor stream and the third liquid stream; and a fourth separator for separating the third vapor stream to produce a fourth vapor stream and a fourth liquid stream.

7. The apparatus according to claim 5, wherein the fourth cooler and the second heater comprise a single heat exchanger that provides heat exchange contact between the second reactor effluent stream and the fourth vapor stream.

8. The apparatus according to claim 5, further comprising a second temperature controller for controlling cooling the second reactor effluent stream based upon a fourth discharge temperature of the fourth cooler and a fifth discharge temperature of the fifth cooler.

9. An apparatus for increasing aromatic content of a reformate stream comprising:

a first reactor for receiving a hydrocarbon feed to produce a first effluent stream;

a first heat exchanger, the first heat exchanger for cooling the first effluent stream to produce a first cooled effluent stream;

a first separator, the first separator connected to the first heat exchanger and operable to separate the first cooled effluent into a first vapor stream and a first liquid stream;

a second heat exchanger, said second heat exchanger for cooling the first vapor stream to produce a second cooled effluent stream;

a second separator, the second separator connected to the second heat exchanger and operable to separate the second cooled effluent into a second vapor stream and a second liquid stream;

a line for supplying the second vapor stream to the first heat exchanger to produce a first heated vapor stream; and a second reactor, said second reactor operable to receive the first heated vapor stream.

10. An apparatus for increasing aromatic content of a reformate stream comprising:

a first reactor for receiving and reacting a hydrocarbon feed stream within to produce a first reactor effluent stream;

a first cooler for cooling and partially condensing the first reactor effluent stream to produce a first vapor stream and a first liquid stream and a second cooler for cooling and partially condensing the first vapor stream to produce a second vapor stream and a second liquid stream;

a first heater for heating the second vapor stream to produce a heated second vapor stream; and a second reactor for receiving the heated second vapor stream;

wherein the first cooler and the first heater comprise a single heat exchanger that provides heat exchange contact between the first reactor effluent stream and the second vapor stream.

11. The apparatus according to claim 10, further comprising a first temperature controller for controlling cooling the first reactor effluent stream based upon a first discharge temperature of the first cooler and a second discharge temperature of the second cooler.

12. The apparatus according to claim 10, further comprising a first separator for separating the first vapor stream and the first liquid stream and a second separator for separating the second vapor stream and the second liquid stream.

13. The apparatus of claim 10, further comprising a third cooler for cooling the first and second liquid streams.

14. The apparatus according to claim 10, further comprising:

a fourth cooler for cooling and partially condensing the second reactor effluent stream to produce a third vapor stream and a third liquid stream and a fifth cooler for cooling and partially condensing the third vapor stream to produce a fourth vapor stream and a fourth liquid stream;

a sixth cooler for cooling the third and fourth liquid streams; and a second heater for heating the fourth vapor stream; and a third reactor for receiving the fourth vapor stream.

15. The apparatus according to claim 14, further comprising a third separator for separating the second reactor effluent stream to produce the third vapor stream and the third liquid stream; and a fourth separator for separating the third vapor stream to produce a fourth vapor stream and a fourth liquid stream.

16. The apparatus according to claim 14, wherein the fourth cooler and the second heater comprise a single heat exchanger that provides heat exchange contact between the second reactor effluent stream and the fourth vapor stream.

17. The apparatus according to claim 14, further comprising a second temperature controller for controlling cooling the second reactor effluent stream based upon a fourth discharge temperature of the fourth cooler and a fifth discharge temperature of the fifth cooler.

* * * * *